United States Patent [19]

Chabrerie

[11] 4,347,456

[45] Aug. 31, 1982

[54] SLIDING ELECTRICAL CONTACT DEVICES

[75] Inventor: Jean-Pierre Chabrerie, Gif-sur-Yvette, France

[73] Assignee: Etat Francais, Paris, France

[21] Appl. No.: 166,366

[22] Filed: Jul. 7, 1980

Related U.S. Application Data

[63] Continuation of Ser. No. 944,860, Sep. 22, 1978, abandoned.

[30] Foreign Application Priority Data

Oct. 3, 1977 [FR] France ..... 77 29716

[51] Int. Cl.[3] ..... H02K 13/00

[52] U.S. Cl. ..... 310/248; 310/219; 310/239

[58] Field of Search ..... 310/178, 220, 219, 237, 310/228, 241, 242, 249, 247, 248, 250–253, 243, 232, 231, 239, 233; 313/357; 339/5 R, 5 L, 5 M, 8 L; 314/60; 13/14, 18 R

[56] References Cited

U.S. PATENT DOCUMENTS

| | | | |
|---|---|---|---|
| 3,200,278 | 8/1965 | Krestel | 310/251 |
| 3,270,306 | 8/1966 | Burski | 310/248 |
| 3,453,513 | 7/1969 | Bates | 310/220 |
| 3,488,842 | 1/1970 | Rochette | 310/251 |
| 3,886,386 | 5/1975 | Hilling | 310/251 |
| 4,071,795 | 1/1978 | Dobbing | 310/219 |

*Primary Examiner*—R. Skudy

*Attorney, Agent, or Firm*—Larson and Taylor

[57] ABSTRACT

Sliding electrical contact devices comprising a conducting track and a brush bearing on the track. The brush is formed by at least one bundle of stiff and very fine wires whose diameter is of about 40 microns, tightly retained in a sole piece 14, projecting from the sole piece and slidingly bearing on the track.

11 Claims, 3 Drawing Figures

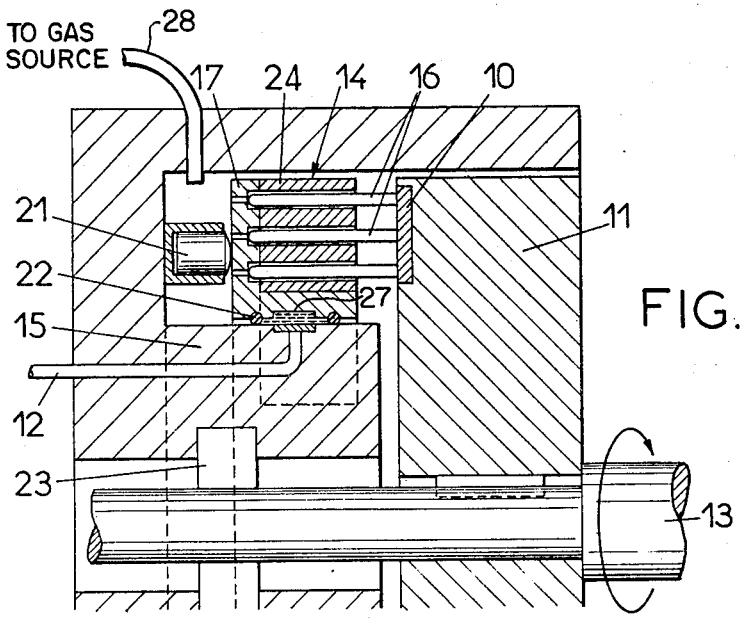
FIG. 1.
FIG. 3.
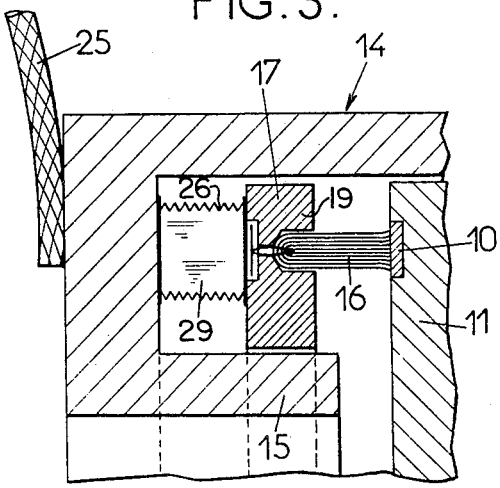
FIG. 2.
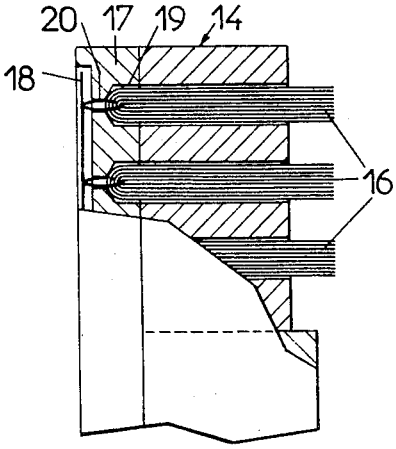

SLIDING ELECTRICAL CONTACT DEVICES

This is a continuation of application Ser. No. 944,860, filed Sept. 22, 1978, now abandoned.

BACKGROUND AND SUMMARY OF THE INVENTION

The present invention relates to sliding electrical contact devices comprising an electrically conducting track and a brush bearing on the track, wherein in operation the track and the brush have a relative movement, transverse to the bearing direction of the brush on the track.

Sliding electrical contacts are widely used in electric machines, particularly in heteropolar or homopolar rotary machines. Contact devices comprising brushes made from metal wires were abandoned a long time ago and substituted with devices having a ring and graphite brushes. The graphite brushes however are subject to disadvantages and troublesome limitations, in particular in respect of the maximum density of current which they can transmit. Their contact potential difference is high. Frictional forces are high and wear is fast. Last, there are severe limitations of the travelling speed.

It is an object of the invention to provide an improved sliding electrical contact device. It is a more particular object of the invention to provide such a device improved in respect of electrical losses, maximum accpetable linear speed and density of current.

According to an aspect of the invention, there is provided a device whose brush is formed by at least one bundle of stiff metal wires whose diameter is less than 80 microns, having a tight connection at one end and bearing on the track at the other end. It will be considered that a wire is "stiff" if, after it is given a straight form, it retains it and does not tend during handling to bend and to become tangled with other similar wires when it is placed in a bundle with them. The tight connection will generally be achieved by securing first end portions of the wires in a sole piece from which they project in a direction which is determined by the connection.

The results obtained with such a device are entirely different from those obtained in the case of wires of current diameter. The contact voltage difference is much lower (which reduces losses), the linear speed may be much higher, the friction is less, the admissible current density is much greater and the working life is lengthened. The difference may probably be explained as follows: the resilience of the individual wires is sufficient for them to remain in contact with the track even when passing over unavoidable irregularities. Since contact is retained continuously, there are no micro-arcing and micro-breakdowns and heating up on contact. The new and advantageous effect is lost if the diameter of the wire is increased beyond about 80 microns.

In practice, the wires will be made from copper alloy. Pairs of material which can be used for the brush and the track include cadmium bronze for the wires and cupronickel containing advantageously 10 to 20% by weight of nickel for the track. The appearance of oxide which rapidly affects the characteristics of the device is avoided by maintaining the brush and the track in a dry and non-oxidizing atmosphere, i.e. neutral, slightly reducing or rarefied. The latter condition is met during operation of the device in space or at high altitude. An argon or even nitrogen atmosphere may generally be suitable.

The connection between the wires and the sole piece can be described as of the "embedding" type; the free length of the wires should be short enough failing which they tend to lie down, which makes in particular reversal of running difficult. In practice, in particular when the device must be able to operate in both directions, a broad estimation is that the projection of the wires must not exceed 20 mm and, preferably, 15 mm; the embedding length may be greater than this value to ensure that they are securely held in place.

The size of the cross-section of the bundle or each bundle, the direction parallel to the travelling direction, should be limited to a value for which all wires are in contact with the track for fully benefiting of the advantages of the invention. Typically, the size of the bundle in the direction parallel to the travelling past will generally not exceed 10 mm.

The invention will be better understood from the following description of preferred embodiments thereof, given by way of non-limiting examples.

SHORT DESCRIPTION OF THE DRAWINGS

FIG. 1 is a diagrammatic view of a first embodiment, in cross-section along a plane passing through the axis of rotation of the track;

FIG. 2 is a view on an enlarged scale showing how the brushes of the device of FIG. 1 are secured to the sole piece; and FIG. 3 is a diagrammatic view of a device which is a modification of that of FIG. 1.

DETAILED DESCRIPTION OF PREFERRED EMBODIMENTS

Referring to FIG. 1, there is shown a device for carrying out electrical current between a track 10 carried by a rotary machine rotor 11 and a supply 12 carried by the stater of the machine. Rotor 11 is carried by shaft 13, centred in the stator by bearing means (not shown).

Track 10 may be a ring of cupronickel fixed to rotor 11 by suitable means (not shown). Typically, it will have a thickness between 5 mm and 1 cm. For simplicity, it will be assumed in the following that the machine is of the homopolar type, the electric current passing directly into the rotor, which is solid or laminated. The track has a bearing face which is flat and perpendicular to the axis of rotation of the track. However, the invention is also applicable if the track is cylindrical.

The non-rotary portion of the device comprises a sole piece 14 (FIGS. 1 and 2) mounted on a fixed sleeve 15 carried by the stator and adapted to move axially thereon. Sole piece 14 carries several bundles or bunches 16 of metal wires distributed according to a regular network and projecting from the sole piece 14 towards track 10. The bundles are each formed from wires which are very fine but however sufficiently stiff to provide good contact with the track. When the latter is made from cupronickel, the bundles 16 may be formed from cadmium bronze wires whose diameter is less than 80 microns and is typically of about 40 microns. For the wires to have sufficient stiffness, failing which they do not remain straight, they are subjected to a metallurgical process. This treatment may consist of cold-hardening provided by causing the wires to follow a serpentine path between a number of successive rollers: the wires thus obtained have waves with an amplitude of the order of 1 mm with a wave length of about 3 mm, which is not inconvenient.

The wires may also be straightened out, but this operation is difficult for a diameter of about 40 microns. In practice, it is generally advantageous to use wires having the minimum diameter obtainable by wire-drawing under normal manufacturing conditions, i.e. without there being frequent breakages.

Bundles 16 have advantageously a circular cross-section with a diameter not exceeding 10 mm. This construction allows in fact convenient mounting. The size of the bundles may however be increased in the direction transverse to the travelling-past direction. Typically, the number of wires per bundle 16 will not exceed 3,000.

Sole piece 14 for receiving the bundles comprises a base plate 17 to which the bundles may be individually fixed by a technique which is widely used in brush-making: each bundle is formed by a package of wires bent in the shape of a hair-pin. Base plate 17 comprises, for each bundle, a blind opening 19 opening rearwardly through a small size hole 20. Each bundle is fixed by a brass wire 18 inserted in hole 20, forming a loop around the bottom of the bundle and leaving the opening 19 again through hole 20 (FIG. 2).

In the embodiment shown in FIG. 1, the bundles 16 are guided by a heat-sink 24 fixed to plate 17, made from electrically and thermally conducting material which removes the heat dissipated in the metal wires and allows the admissible current density to be increased. This heat-sink 24 fixed to the base plate 17 may occupy only a reduced angular sector thereof. By way of example, nine bundles 16 may be used disposed in a square lattice.

The end portions of the bundles must be maintained in bearing contact with track 10. A convenient construction for achieving this result consists in placing jacks 21 between the stator and the sole piece. The jacks 21 are supplied with fluid by supply means (not shown). To balance the forces, the bundles will then be evenly distributed about shaft 13.

Electrical current is fed to base plate 17 through a liquid metal connection. The provision of such a liquid metal connection is no problem in the present case since there is no fast movement between sole piece 14 and sleeve 15. The liquid, which is indicated at 27, may occupy a clearance provided therefor between the sleeve and the sole piece and may be retained by O-ring seals 22. The liquid metal may be mercury or sodium-potassium eutectic.

To avoid oxidation of the contacts (and violent oxidation reaction of the Na-K eutectic if the latter is used) a neutral or slightly reducing atmosphere is maintained about the electrical connection. In the embodiment shown in FIG. 1, a connection to such an atmosphere is indicated at 28 and a rotary seal 23 between the shaft 13 and the stator separates the space inside the stator from the atmosphere. Thus, this arrangement constitutes means for maintaining the brush and track in a dry non-oxidizing atmosphere. Means for scavenging with the gas or mixture of gases chosen (hydrogen-nitrogen mixture for instance) can be provided.

The assembly is simpler than the conventional graphitic brushes. There is no need to provide complex brush-holders with a long guiding length in which the brushes must slide progressively as they wear. For a travelling-past speed of the track of 40 m/s (which corresponds to the practical limit of use of graphitic brushes), it has been found that the power consumption is reduced in a ratio of the order of 10 under the same conditions of use and that the maximum current densities may be multiplied by 5, which results in a considerable saving of space.

In the modified embodiment shown in FIG. 3 (where a single bundle is shown and where the parts already shown in FIG. 1 bear the same reference numbers) there is no heat-sink. The wires of bundle 16 are fixed as in the embodiment of FIG. 1 and moreover by means of solder, e.g. tin solder, placed in opening 19.

The bundles 16 are retained in bearing contact with track 10 by resilient bellows 26 made from stainless steel, distributed angularly about the axis of the device, cylindrical or elongated in the circumferential direction. The bellows 26 also ensure current supply and, for this purpose, the bellows are sealingly fixed to the stator and to the sole piece and contain an electrically conducting liquid, generally mercury, indicated at 29: a bunch 25 is fixed to the stator. The mercury 29 may be maintained under a substantially hydrostatic constant pressure by any suitable means (not shown).

The device is of particular interest when the bundles of wires and the friction track are subjected to a finishing process before use. Advantageously, the track may be very carefully polished, then mechanically or chemically cleaned and covered with a layer of gold a few microns thick. The bundles of wires are advantageously cleaned chemically. The resulting deoxidation reduced the contact voltage difference at the end of the wires in contact with the track and improves the transverse conduction which results in easier current exchange between the different wires.

By way of example, it can be indicated that a contact device for a homopolar machine has been built and tested and has the following characteristics: each bundle comprises 2,000 to 3,000 cadmium bronze wires with a diameter of 40 microns fixed in an opening 8 mm in depth and which project by 15 mm. The track is made from polished bronze, having a resistivity of 2 $\mu\Omega$-cm. After several hundred hours of operation with an apparent current density (ratio between the current value and the overall cross-sectional area of the bundle) of 1 A/mm$^2$, no appreciable deterioration of the characteristics was found.

The invention is suitable for several uses, among which in unipolar machines, including superconducting machines; unipolar variators; and collector-brush assemblies for rotary machines (e.g. asynchronous motors and turbo-alternators).

I claim:

1. An electrical contact device for current transfer comprising:

a brush having at least one bundle of stiff wholly metal wires of a diameter less than 80 microns and sole means with which one end portion of said bundle has a tight connection retaining said end portion in a predetermined direction with respect to said sole means, a track arranged to be moved in operation in a direction transverse to said predetermined direction with respect to said brush, means for maintaining the other end portion of said bundle in rubbing contact with the track, and means for maintaining the brush and track in a dry non oxidizing atmosphere.

2. A device according to claim 1, wherein the one end portions of the wires are embedded in the sole means out of which they project toward the track.

3. A device according to claim 2, wherein the wires project from the sole means over a length less than 20 mm.

4. A device according to claim 1, wherein the wires are made from cadmium bronze and the track is made from copper-nickel alloy.

5. A device according to claim 4, wherein the copper-nickel alloy contains from 10 to 20% nickel by weight.

6. A device according to claim 1, wherein said bundle has a cross-sectional area whose size in the direction parallel to the direction of travel of the track is at most 15 mm.

7. A device according to any one of the preceding claims, wherein the brush comprises several said bundles which each have an approximately circular cross-section and which are distributed according to a regular pattern.

8. A device according to claim 1, wherein each bundle comprises wires bent double at the center portion thereof to form a hair-pin shape, the bent center portions of the wires being secured to the sole means.

9. A device according to claim 8, further including a heat sink laterally supporting the or each said bundle.

10. A device according to claim 1, wherein the track is a flat collector mounted for rotation about an axis, said device further comprising a stationary sleeve, having a cylindrical surface coaxial with the collector axis, for supporting said sole means for movement parallel to said axis, a plurality of axially spaced O-rings carried by said sole means and defining an annular space between the sleeve and the sole means, and a body of liquid metal disposed in said annular space for electrical current transmission between said sleeve and sole means.

11. A device according to claim 10, wherein the liquid metal is mercury or sodium-potassium eutectic.

* * * * *